US007344233B2

(12) United States Patent
Studer et al.

(10) Patent No.: US 7,344,233 B2
(45) Date of Patent: Mar. 18, 2008

(54) REPLACEABLE INK SUPPLY WITH INK CHANNELS

(75) Inventors: Anthony D. Studer, Albany, OR (US); Kevin D. Almen, Albany, OR (US); David J. Benson, Albany, OR (US); David M. Hagen, Corvallis, OR (US); Cary R. Bybee, Whispering Pines, NC (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 297 days.

(21) Appl. No.: 11/040,541

(22) Filed: Jan. 21, 2005

(65) Prior Publication Data

US 2006/0164471 A1 Jul. 27, 2006

(51) Int. Cl.
*B41J 2/175* (2006.01)

(52) U.S. Cl. ..... 347/86; 347/85

(58) Field of Classification Search ..... 347/85, 347/86, 87, 47; 438/21
See application file for complete search history.

(56) References Cited

U.S. PATENT DOCUMENTS

| | | | | |
|---|---|---|---|---|
| 4,015,272 | A | 3/1977 | Yamamori et al. | |
| 5,182,581 | A * | 1/1993 | Kashimura et al. | 347/87 |
| 5,444,474 | A * | 8/1995 | Ohtsubo et al. | 347/87 |
| 5,509,140 | A * | 4/1996 | Koitabashi et al. | 347/86 |
| 5,537,134 | A | 7/1996 | Baldwin et al. | |
| 5,623,287 | A * | 4/1997 | Saikawa et al. | 347/47 |
| 5,784,088 | A * | 7/1998 | Ujita et al. | 347/86 |
| 5,790,158 | A | 8/1998 | Shinada et al. | |
| 5,847,735 | A | 12/1998 | Betschon | |
| 6,109,742 | A * | 8/2000 | Higuma et al. | 347/86 |
| 6,244,698 | B1 | 6/2001 | Chino et al. | |
| 6,382,786 | B2 * | 5/2002 | Iwanaga et al. | 347/86 |
| 6,419,349 | B1 * | 7/2002 | Iwanaga et al. | 347/86 |
| 6,464,346 | B2 | 10/2002 | Otis, Jr. et al. | |
| 6,557,989 | B1 | 5/2003 | Hirosawa et al. | |
| 6,652,080 | B2 | 11/2003 | Childs et al. | |
| 6,655,792 | B2 | 12/2003 | Benson et al. | |
| 6,739,708 | B2 | 5/2004 | Studer et al. | |
| 6,742,864 | B2 | 6/2004 | Therien et al. | |
| 6,776,479 | B2 * | 8/2004 | Ardito et al. | 347/86 |
| 2003/0109073 | A1 * | 6/2003 | Park et al. | 438/21 |
| 2006/0232649 | A1 * | 10/2006 | Wu et al. | 347/86 |

FOREIGN PATENT DOCUMENTS

| | | |
|---|---|---|
| GB | 2 293 142 | 3/1996 |
| GB | 2 298 394 | 9/1996 |
| JP | 2002-331683 | 11/2002 |

OTHER PUBLICATIONS

European Search Report for European Application No. 06100383. Report issued May 29, 2007.

* cited by examiner

*Primary Examiner*—Hai Pham
*Assistant Examiner*—Carlos A. Martinez, Jr.

(57) ABSTRACT

A replaceable ink supply comprises an ink container with an internal chamber formed from a plurality of walls. An ink reservoir block can be located within the internal chamber. Further, a channel can be formed in at least one wall of the internal chamber and the channel having an open side exposing a portion of the ink reservoir block.

18 Claims, 6 Drawing Sheets

REPLACEABLE INK SUPPLY WITH INK CHANNELS

FIELD OF THE INVENTION

The present invention relates generally to replaceable ink supplies.

BACKGROUND

A common type of ink jet printer uses replaceable ink supplies that provide ink to tiny nozzles, or orifices, which form the ink into micro-droplets and eject the ink onto a print media. Ink jet nozzle droplet generators such as piezoelectric transducers or wave propagators can be used in ink jet systems. With most ink jet equipment, the ink ejector or pen is typically mounted on a carriage, which scans across the print media. As the carriage scans, the micro-droplets are deposited onto the print media via a print head.

The ink jet pen may have a self-contained reservoir attached for storing and providing appropriate amounts of ink to the printhead during a printing cycle. These self-contained reservoirs are commonly referred to as ink cartridges. If reusable semi-permanent, or permanent pens rather than print cartridges are employed, ink is either supplied from remote ink containers or the ink container is mounted on the carriage with the pen.

Most ink jet printers can supply both color ink and black ink. To provide a color printing capability, ink cartridges or containers for each color can supply colored ink to a print head which mixes the colors on the print media to obtain a desired hue and shade. Similarly, black ink can be supplied from a black ink cartridge or container to a print head, which then deposits the ink onto the print media to generate the desired shade of gray or black.

To prevent ink leakage from a typical ink jet printing system that utilizes one or more ink reservoir containers, it is common to exert a force on the ink to retain it within the ink reservoir. For example, many ink reservoirs contain a capillary medium, such as foam (or an ink sponge), which is capable of absorbing and retaining ink. The capillarity of the capillary medium exerts a force (capillary force) that draws the ink into the capillary medium, preventing the ink from leaking out of the capillary medium and thus the reservoir. Many ink reservoirs initially contain enough ink to wet the capillary medium up to a percentage of the height of the capillary medium (e.g., 75 to 95 percent) with the remaining upper portion of the capillary medium containing air, for example. Moreover, ink reservoirs often include an air-filled space between the top of the capillary medium and a cover of the ink reservoir.

Capillary medium-based ink reservoirs are typically vented to atmospheric pressure to prevent excessive negative (e.g., vacuum type) pressures within the reservoir that can reduce or prevent ink flow to the print head. Venting is often provided by a vent disposed in the cover of the ink reservoir. In this situation, air may flow through the vent between an atmosphere surrounding an exterior of the ink reservoir and an interior of the ink reservoir. In addition, venting relieves pressure buildups that can occur when an ink reservoir is exposed to extreme environmental conditions. For example, extreme conditions may be encountered during shipping, such as high temperatures in motor vehicles or low pressures in airplanes at high altitudes. In such situations, air flows through the vent between the interior of the ink reservoir and the atmosphere surrounding the exterior of the ink reservoir.

In some situations, air becomes trapped in the capillary medium (e.g., while adding ink to the ink reservoir) and forms air pockets or voids within the capillary medium. This situation is amplified for applications involving hydrophilic capillary media because hydrophilic capillary media normally do not require a vacuum during filling. Moreover, when the ink reservoir is subjected to stresses during shipping and/or handling, such as dropping the ink reservoir, the volume of entrapped air can increase or air from the space above the capillary medium can be displaced into the capillary medium. The air within the capillary medium may lead to failure when the ink reservoir is exposed to high temperatures and/or low pressures. In particular, the high temperatures and/or low pressures cause the air within the capillary medium to expand and force ink out of the vent instead of air.

If ink is expelled during shipping, the expelled ink can contaminate the exterior of the ink container and any surrounding packaging. Expelled ink can also interact with the characteristics of the ink in the reservoir and degrade overall print quality. Additionally, expelled ink in multi-colored containers may contaminate the other colors.

DETAILED DESCRIPTION

Figure 1:
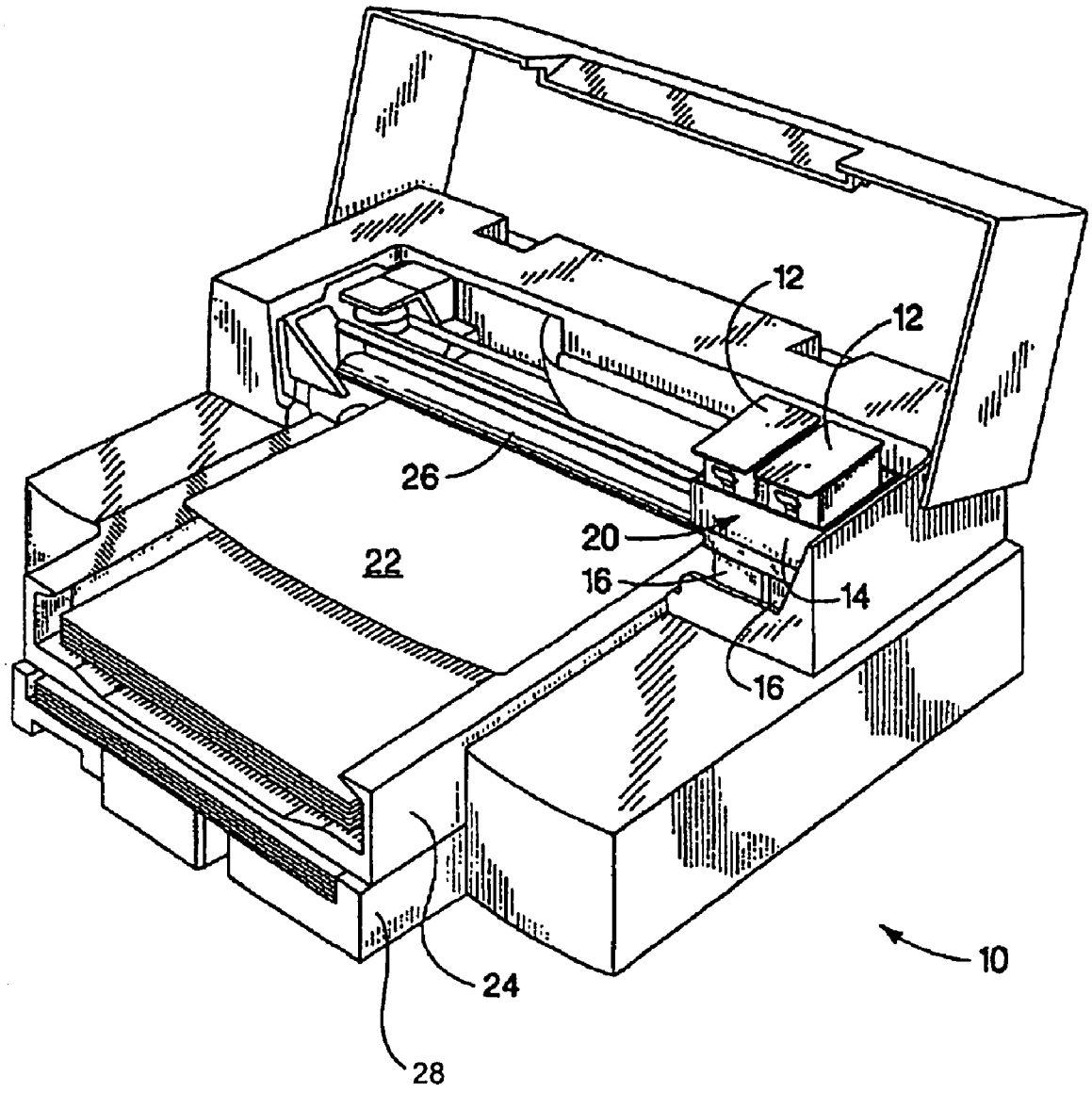
FIG. 1 is a perspective view of an ink jet printing system with ink containers in an exemplary embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. The following detailed description and exemplary embodiments of the invention will be best understood by reference to the accompanying drawings, wherein the elements and features of the invention are designated by numerals throughout.

FIG. 1 illustrates a perspective view of an embodiment of an ink jet printing system as shown with its cover open, generally indicated at 10. Specifically, FIG. 1 illustrates an ink jet printing system including a plurality of replaceable ink containers 12 that are installed in a receptacle 14. Ink is provided from the replaceable ink containers through ports to ink jet print heads 16. The ink jet print heads deposit ink onto a print media 22, such as paper. As ink is ejected from the print heads, the print heads are replenished with ink from the replaceable ink containers.

The replaceable ink containers 12, the receptacle 14, and the inkjet print heads 16 are attached to a moveable printer carriage 20 that moves with respect to the print media on a slide rod 26 to accomplish printing. The print media is pulled from a storage tray 28 through the printer and placed in a deposit tray 24. As the print media is moved through the printer, the printer carriage moves the print heads across the print media, thereby depositing ink onto the print media.

Figure 2:
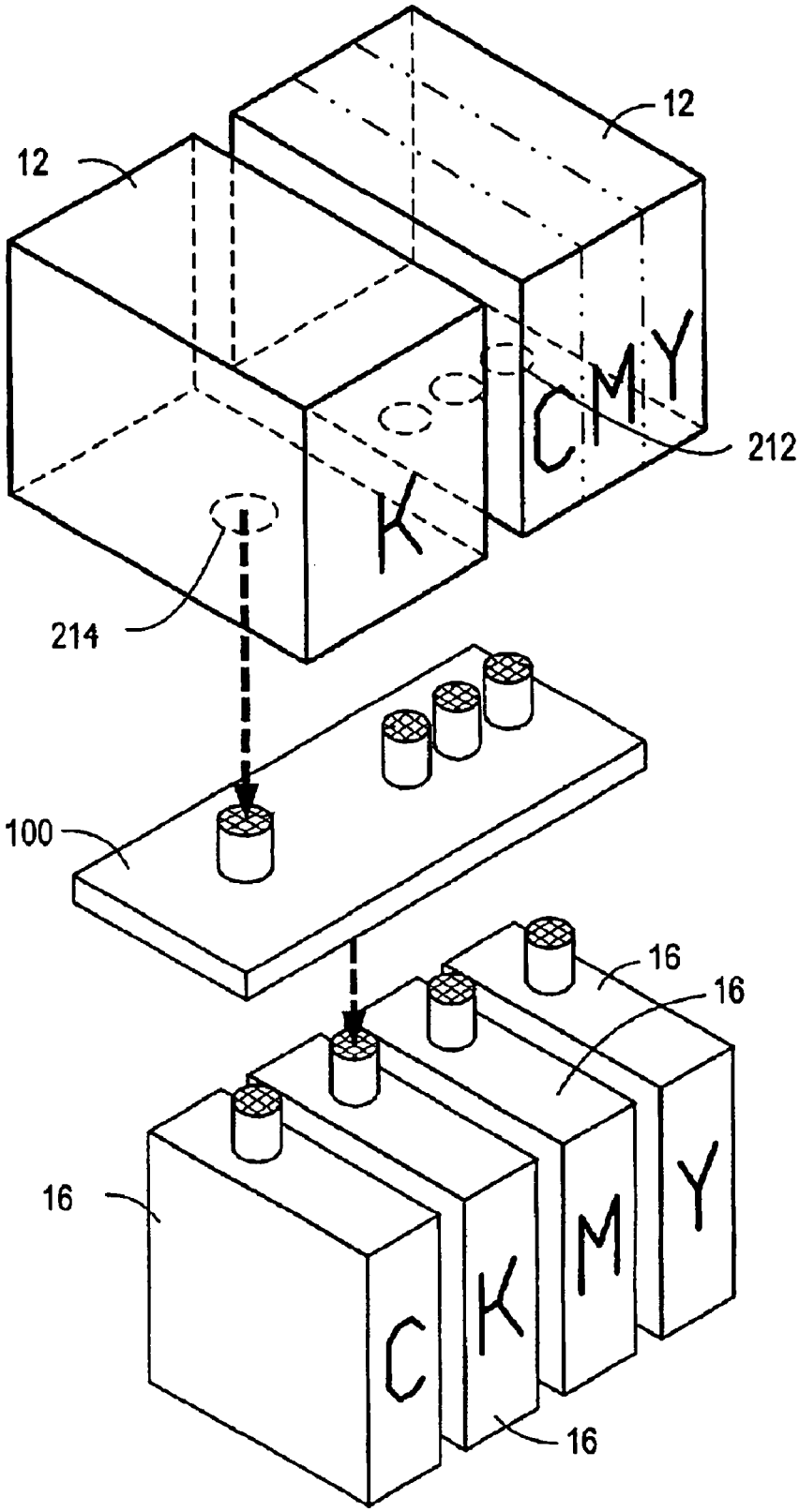
FIG. 2 is a perspective view of ink supplies with a coupling manifold and printheads in an exemplary embodiment of the invention.

FIG. 2 illustrates a diagram of an exemplary ink delivery system. Specifically, FIG. 2 illustrates a pair of replaceable ink containers 12 where one is for black ink and the other is for color ink. The print containers are installed into a receptacle (shown as 14 in FIG. 1) and contain a hydrophilic foam capillary material, which retains the ink. Inkjet print heads 16 are in fluid communication with the containers through a manifold 100 that interconnects the ink containers with the print heads. The inkjet printing system shown in FIG. 2 includes three color ink output 212 containing three separate ink colors that are typically cyan, magenta and yellow and a second cartridge that provides black ink output 214. It will be appreciated that while the replaceable ink containers described are common in standard inkjet printers, other configurations such as six color cartridges may also be used.

In certain implementations, a replaceable ink supply system is provided for an ink jet printer having an ink accumulator design that tends to increase the shipping and environmental robustness of the ink container in the ink supply system.

By way of example, one ink accumulator design includes the formation of at least one shallow open-sided channel in at least one of the walls within the ink chamber of the ink container such that when a foam-based or other like ink reservoir block is placed within the ink chamber it substantially covers the open side of the channel. By closing the open side of the channel, the reservoir block may create one or more capillary tubes with the channels that ink can flow into if the ink supply is inverted, dropped, or otherwise experiences environmental pressure changes during shipping.

In certain implementations, a lid portion of the ink container may include a series of raised castellations or other like features that extend from the lid into the ink chamber and substantially match with and substantially enclose the top of the channels in order to form cavities. With the channels capped by the castellations of the lid portion, air that is trapped in the capillary tube of the channel may be pushed by rising ink up into the cavities where bubbles are formed.

In certain implementations, such castellations may also include vent notches or the like that allow the formed bubbles to escape from the cavities. In this manner, pressure within the ink chamber may be equalized as the air exits through one or more openings through the lid portion. In certain implementations, such openings may connect to one or more labyrinths internal to and/or on the external side of the lid portion, which provide a path for air to enter or exit the ink chamber. These labyrinths essentially provide an air communication path between the interior of the ink chamber while reducing the overall water-vapor-transmission-rate (WVTR) of the ink in order to extend the overall life expectancy of the ink container.

Figure 3:
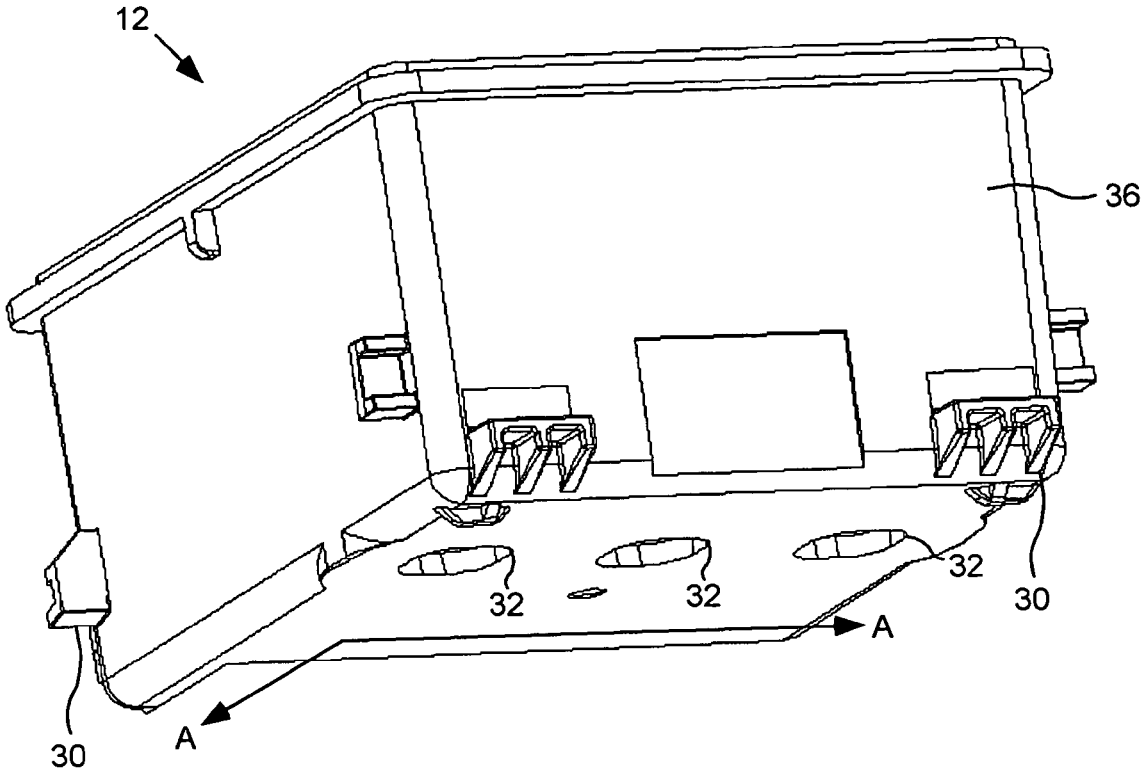
FIG. 3 illustrates a perspective view of an ink supply cartridge in an exemplary embodiment of the invention.

With reference to FIG. 3, illustrated is a perspective view of the exemplary ink supply container 12 shown in FIG. 1. Specifically, FIG. 3 illustrates a tri-color container 12 with a body 36, configured to fit into a receptacle (shown as 14 in FIG. 1). The ink container may lock into the receptacle with a set of locking tabs and guides 30 along with a latch (not shown) located on the back of the body 36. Ink generally flows out of the ink container through ports 32 located on the bottom of the ink cartridge when printing is taking place.

Figure 4:
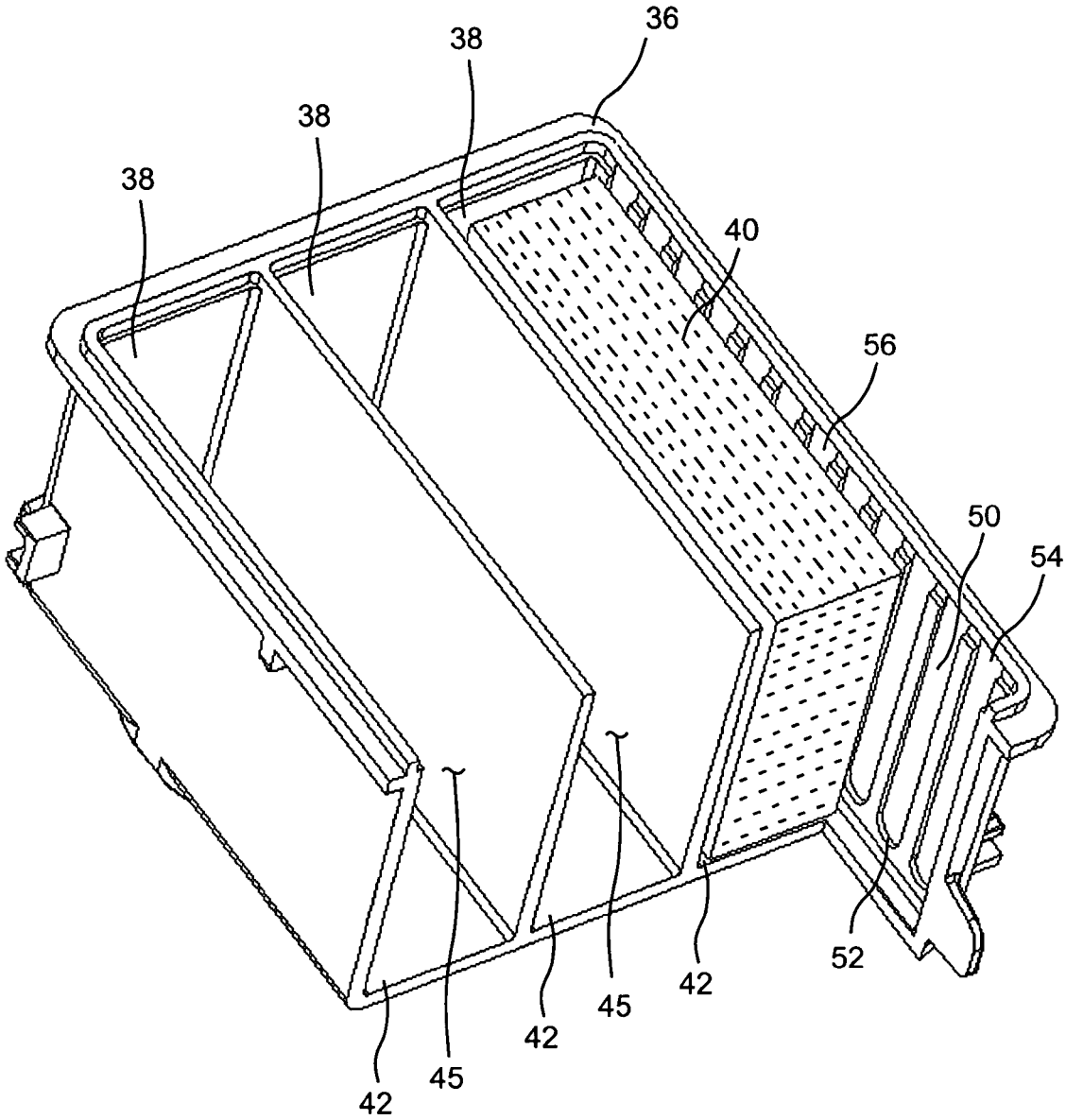
FIG. 4 illustrates a cut-away perspective view of an exemplary embodiment of the ink container taken along line A-A of FIG. 3.

FIG. 4 illustrates a cut-away view of the replaceable ink supply 12 discussed above, taken along line A-A of FIG. 3. This exemplary ink container includes three internal chambers 45 formed from a plurality of walls 38 and a bottom 42.

An ink reservoir block 40 is shown within one of the internal chambers 45. Reservoir block 40 in this exemplary embodiment is configured to fit snugly against the walls of the internal chamber.

As further illustrated in the example of FIG. 4, one or more channels 50 may be formed in one or more walls of the internal chamber. As described below, channels 50 allow for ink to be stored in the channel at certain times, for example, as a result of environmental changes or distribution handling. Some of the environmental changes that have previously caused the ink in the ink chamber to be expelled out of the ink container include pressurization changes, temperature changes, or stresses induced from handling or impacts.

In this example, channels 50 are substantially rectangular in cross-sectional shape and have a semi-circular end 52. Channels may extend from substantially the top to substantially the bottom of the ink container 12. In certain embodiments, channel 50 may extend to a predetermined distance above the bottom 42 of the internal chamber 45, which helps to avoid the condition wherein ink left in the channel may flow along bottom 42 and possibly leak out from the ports 32 (FIG. 3).

End 52 of channels 50 may be semi-circular in shape (e.g., use a radius edge) to inhibit ink from becoming trapped in sharp corners when the ink later flows out of the channels 50 and back into reservoir block 40.

Here, in this example, channels 50 are located vertically so that the ink and air may flow upward toward the lid portion (not shown in FIG. 4), and wherein air is then able to escape from chamber 45 (e.g., through an opening in the lid portion) and possibly through one or more labyrinths of the lid portion.

It will be appreciated that while the channels shown in FIG. 4 are substantially rectangular in cross-sectional shape, there are other geometric configurations that may be used. For example, the channels could have a cylindrical cross-sectional shape. The end 52 may also be of a different shape, for example, end 50 may include a hemispherical or partially hemispherical bottom end.

In FIG. 4, the top 54 of channel 50 is open and configured to match certain features on the internal side of the lid portion as described in greater detail below with regard to FIG. 5.

By way of further example, channels 50 illustrated in FIG. 4 may have a depth of approximately 0.5 mm, a width of approximately 3.0 mm, and a length that extends from substantially top to bottom of the ink container 12. In other implementations, channel(s) 50 can be made deeper to increase robustness in a lid-up orientation (e.g., during shipping/storage), however, this may decrease efficiency and robustness in a lid-down orientation.

There may be just one channel in one of the walls of the internal chamber or there may be a plurality of channels as needed for a specified configuration. Although the channels are only shown on one wall inside one chamber of the ink container illustrated in FIG. 4, channels 50 can be incorporated in any number of side walls for one or more of the ink chambers.

In certain implementations, one or more of channels 50 may have a surface finish. For example, channels 50 may have a semi-rough, non-directional surface finish of approximately 0.8 μm. This exemplary surface finish is valuable in facilitating capillary action in the channels. A semi-rough surface finish also aids in uniform wicking of the ink into the channel. The wicking is caused by the surface tension of the ink interacting with microscopic peaks on the surface of the channel. Similarly, the non-directionality of the surface finish tends to inhibit ink from flowing into or out of the channel in microscopic grooves. It will be appreciated by those skilled in the art that while the surface finish of the illustrated embodiment is 0.8 μm, other finish configurations may be used. For example, the surface finish may be rough or semi-smooth and still achieve the desired capillary action properties.

In some embodiments, the ink reservoir block 40 is a foam block containing a hydrophilic capillary material to retain ink, such as bonded polyester/polyolefin fiber or melamine. Other hydrophilic materials can also be used for the ink reservoir block as known to those skilled in the art. The foam block may be designed to fit snugly within the internal ink chamber 45. When the foam block is in the internal ink chamber, the foam block substantially closes off the open side of the channels formed into the wall of the internal ink chamber creating a capillary tube 56.

Hydrophilic capillary foam materials are known to contain air pockets which become trapped within the block as the material absorbs ink. These air pockets can force ink out of the material when atmospheric pressure changes occur. This ink may then try to find its way out of the container through the path of least resistance. Often the path of least resistance is through the sealing tape that is placed over the ports on the ink container or labyrinths in the ink container lid. During a temperature or pressure change, the presence of the channels provides a volume to accumulate free ink being expelled by the reservoir, allows entrapped air to escape, and minimizes leakage of ink from out of the container.

Figure 5:
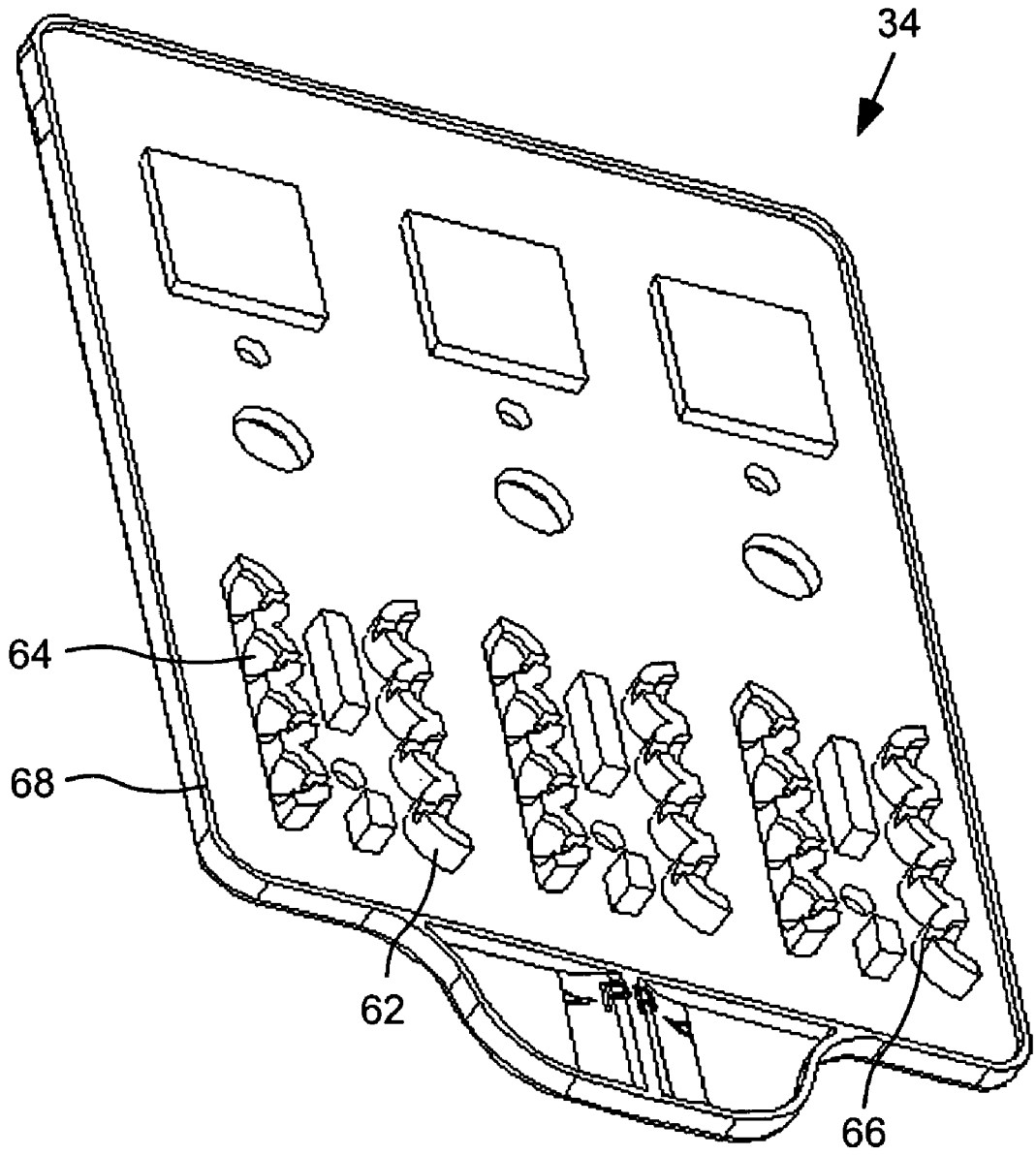
FIG. 5 illustrates a perspective view showing an internal side of a lid portion of the exemplary ink supply cartridge of FIG. 3.

With reference to FIG. 5, a perspective view of an exemplary lid 34 is illustrated. Interior side of lid 34 may have a lip 68 which encloses the ink container body (shown as 36 in FIG. 3) and a series of ridges 62 or features that protrude from the inside of the lid into the interior of the ink container. The ridges or features have a semi-circular side 62 and a semi-hemispherical interior cavity 64. The semi-hemispherical features line up with to the location of the channels in the internal chamber of the ink container (shown as 54 in FIG. 4). These semi-circular features may be referred to as "castellations" because of their resemblance to the turrets and battlements in the style of a castle.

The channels may be open to the inside top end of the ink container chamber and consequently any air or ink contained in the channels may travel into the matching cavity or feature. In this example, the semi-circular side of each castellation may have a vent notch 66 that allows fluid communication between the cavity and the surrounding environment under the lid. This fluid communication tends to equalize pressure within the ink container.

The semi-hemispherical castellation features coincident with the channels help facilitate air bubble growth and retention at the top of the accumulator channels. During a change in pressure or temperature, these bubbles tend to retain free ink in the channels when the ink supply is in both the lid-up and more importantly, the lid-down orientation. As the surface tension of the ink increases and the width and depth of the channels decrease, this mechanism becomes more effective. For simplification purposes, only four of the castellation features on the lid are shown in FIG. 5. However, any number of castellations can be used in the lid, and the number of castellations can range from just one castellation up to any practial number of castellations (e.g., hundreds or thousands).

Figure 6:
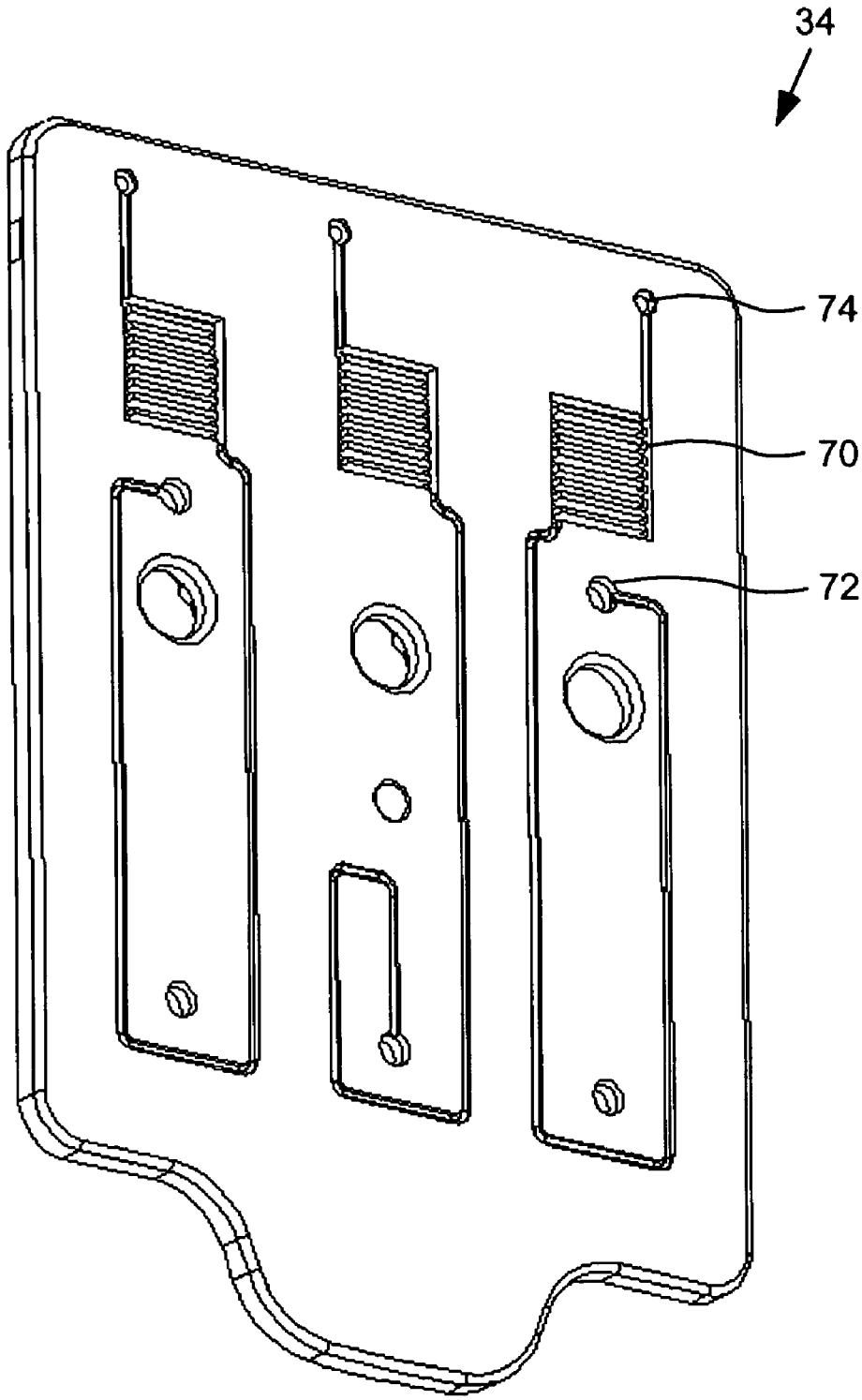
FIG. 6 illustrates a perspective view showing an external side of a lid portion of the exemplary ink supply cartridge of FIG. 3.

FIG. 6 illustrates a perspective view showing an example of the external side of lid 34 in accordance with certain further optional aspects of the embodiment. Specifically, the exterior side of exemplary lid 34 includes a labyrinth 70 formed therein. Labyrinth 70 includes a path that may include a depression, a tunnel, or other like configuration. A labyrinth hole 72 allows fluid communication between the interior of the ink container and labyrinth 70 on the external side of lid 34. A circular recession 74 may be included in the lid at the end of the labyrinth so the molded end of the path has a clean opening.

Labyrinth 70 allows air to vent with respect to the pressure outside the ink container while minimizing the WVTR of the ink in the reservoir block. This labyrinth also tends to equalize the pressure within the ink container as ink is drained from the ink reservoir block during printing. Three labyrinths are shown in FIG. 6 (one for each chamber) but any number of labyrinths can be used as is deemed appropriate for a specific embodiment of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A replaceable ink supply, comprising:

an ink container including an internal chamber formed from a plurality of walls;

an ink reservoir block within the internal chamber; and a channel formed in at least one wall of the internal chamber, the channel having an open side exposing a portion of the ink reservoir block, a first end and an open second end; and a lid attached to the ink container and covering the internal chamber, the lid including a feature that aligns with and terminates the open second end of the channel.

2. The replaceable ink supply in accordance with claim 1, wherein ink from the ink reservoir block enters into the channel in response to an environmental change.

3. The replaceable ink supply in accordance with claim 1, wherein the channel has a semi-rough, non-directional surface finish.

4. The replaceable ink supply in accordance with claim 1, wherein the channel is substantially rectangular or cylindrical in a cross sectional shape.

5. The replaceable ink supply in accordance with claim 1, wherein the channel is substantially semi-circular or hemispherical in shape at a first end of the channel.

6. The replaceable ink supply in accordance with claim 1, wherein the feature includes a vent notch.

7. The replaceable ink supply in accordance with claim 1, wherein the lid includes a labyrinth path connecting the internal chamber with an external atmosphere.

8. A foam based replaceable ink supply, comprising:

an ink container including an internal chamber with a plurality of walls and a bottom;

an ink reservoir block configured to be placed within the internal chamber;

a channel formed in at least one wall of the internal chamber, the channel extending longitudinally from substantially a top of the internal chamber and to a predetermined distance above the bottom of the internal chamber, wherein the channel is closed at a first end and open at a second end; and a lid attached to the ink container and covering the internal chamber, the lid including a feature that aligns with and terminates the open second end of the channel.

9. The foam based replaceable ink supply in accordance with claim 8, wherein the channel has a semi-rough non-directional surface finish.

10. The foam based replaceable ink supply in accordance with claim 8, wherein the channel is substantially cylindrical in a cross-sectional shape, hemispherical in shape at a first end of the channel.

11. The foam based replaceable ink supply in accordance with claim 8, wherein the feature includes vent notches.

12. The foam based replaceable ink supply in accordance with claim 8, wherein the ink container lid includes a labyrinth path connecting the internal chamber with an external atmosphere.

13. A foam based replaceable ink supply, comprising:

an ink container including an internal chamber with a plurality of walls;

an ink reservoir block configured to be placed within the internal chamber;

a channel formed in at least one wall of the internal chamber having an open side exposing a portion of the ink reservoir block, having a first end and an open second end; and an ink container lid coupled to the ink container wherein the ink container lid has a labyrinth path connecting the internal chamber with an external atmosphere, and the ink container lid including a feature that aligns with and terminates the open second end of the channel.

14. The foam based replaceable ink supply in accordance with claim 13, wherein the channel has a semi-rough, non-directional surface finish.

15. The foam based replaceable ink supply in accordance with claim 13, wherein the channel is substantially cylindrical in a cross sectional shape, hemispherical on a first end of the channel.

16. The foam based replaceable ink supply in accordance with claim 13, wherein the feature includes a vent notch.

17. A replaceable ink supply, comprising:

an ink container means for storing ink, the ink container means having an internal chamber formed from a plurality of walls;

an ink reservoir block means for storing ink within the internal chamber; and a channel means formed in at least one wall of the internal chamber for storing ink from the ink reservoir block means in the channel means in response to environmental changes, the channel means for storing ink including an open end; and a lid means for covering the internal chamber, the lid means including a feature that aligns with and terminates the open end of the channel means.

18. The replaceable ink supply in accordance with claim 17, wherein the channel means has a semi-rough, non-directional surface finish.

* * * * *